US007680434B2

(12) United States Patent
Lee et al.

(10) Patent No.: US 7,680,434 B2
(45) Date of Patent: Mar. 16, 2010

(54) DEVELOPING CARTRIDGE, IMAGE FORMING APPARATUS HAVING THE SAME, AND MAINTENANCE METHOD OF DEVELOPING CARTRIDGE

(75) Inventors: Jun-hee Lee, Suwon-si (KR); Gun-soo Chang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 133 days.

(21) Appl. No.: 11/941,210

(22) Filed: Nov. 16, 2007

(65) Prior Publication Data

US 2008/0226340 A1 Sep. 18, 2008

(30) Foreign Application Priority Data

Mar. 15, 2007 (KR) ..... 10-2007-0025432

(51) Int. Cl.
*G03G 15/02* (2006.01)
*G03G 21/18* (2006.01)

(52) U.S. Cl. ..... 399/115; 399/113

(58) Field of Classification Search ..... 399/115, 399/113, 110, 111, 109, 128, 176
See application file for complete search history.

(56) References Cited

U.S. PATENT DOCUMENTS 4,413,897 A * 11/1983 Kohyama ..... 399/128
6,026,259 A * 2/2000 Yamaki et al. ..... 399/128
7,463,845 B2 * 12/2008 Suda et al. ..... 399/115
7,493,061 B2 * 2/2009 Hatori et al. ..... 399/111
7,509,062 B2 * 3/2009 Kikuchi et al. ..... 399/109 X
2007/0147864 A1 * 6/2007 Markovics et al. ..... 399/128 X
2007/0269234 A1 * 11/2007 Kurita et al. ..... 399/111

FOREIGN PATENT DOCUMENTS

| | | | |
|---|---|---|---|
| EP | 0 632 342 | | 1/1995 |
| JP | 04-274452 | A * | 9/1992 |
| JP | 06-317970 | A * | 11/1994 |
| JP | 2000-242063 | A * | 9/2000 |
| JP | 03347476 | | 11/2002 |
| JP | 2005-352228 | A * | 12/2005 |
| KR | 2005-106653 | | 11/2005 |

OTHER PUBLICATIONS

Korean Office Action dated Aug. 25, 2009 issued in KR Application No. 10-2007-0025432.

* cited by examiner

*Primary Examiner*—Sophia S Chen
(74) *Attorney, Agent, or Firm*—Stanzione & Kim LLP

(57) ABSTRACT

A developing cartridge includes a main frame including a photosensitive medium, and a charging member frame including a charging member to charge the photosensitive medium and detachably disposed at the main frame. The main frame includes a plurality of frame reference grooves, and the charging member frame includes a plurality of frame reference projections to be inserted into the plurality of frame reference grooves of the main frame.

36 Claims, 8 Drawing Sheets

DEVELOPING CARTRIDGE, IMAGE FORMING APPARATUS HAVING THE SAME, AND MAINTENANCE METHOD OF DEVELOPING CARTRIDGE

CROSS-REFERENCE TO RELATED APPLICATIONS

This application claims the benefit under 35 U.S.C. § 119 (a) from Korean Patent Application No. 2007-25432 filed Mar. 15, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to a developing cartridge with an improved structure, an image forming apparatus having the same, and a maintenance method of a developing cartridge.

2. Description of the Related Art

Generally, image forming apparatuses such as laser printers, copiers, etc., form an electrostatic latent image on a photosensitive medium, supply toner to the electrostatic latent image so as to develop the electrostatic latent image into a toner image, and then transfer the toner image onto a printing medium, thereby performing a printing operation.

Nowadays, a developing cartridge, in which a photosensitive medium and a developing member to supply toner are associated as one unit, has been widely used so that maintenance and repair of the image forming apparatus become easy.

FIG. 1 is an exploded perspective view illustrating a conventional developing cartridge.

Referring to FIG. 1, a conventional developing cartridge 1 includes a lower frame 10 and an upper frame 20.

In the lower frame 10 is disposed a photosensitive medium 11 on which a laser beam emitted from a light exposure unit (not illustrated) forms an electrostatic latent image. A charging roller 13 that charges a surface of the photosensitive medium 11 by a predetermined voltage is disposed at a side of the photosensitive medium 11. Also, a developing roller 15 to supply the electrostatic latent image with toner is disposed to rotate in contact with the photosensitive medium 11 at a side of the charging roller 13. A toner regulating member 17 and a toner supplying roller 16 are disposed at a side of the developing roller 15. The toner supplying roller 16 supplies the developing roller 15 with toner which is stored in a toner storing space 18 of the lower frame 10. The toner regulating member 17 is disposed to be in contact with the developing roller 15 and regulates toner conveyed onto the developing roller 15 by the toner supplying roller 16 into a thin toner layer. In the lower frame 10, a used toner storing space 19 is disposed opposite to the toner storing space 18 with respect to the photosensitive medium 11. Therefore, used toner removed from the surface of the photosensitive medium 11 is stored in the used toner storing space 19.

The upper frame 20 is assembled on an upper side of the lower frame 10 and functions as a lid or a cover to close up the upper side of the lower frame 10. The upper frame 20 is provided with a laser beam opening 21 through which a laser beam emitted from the light exposure unit passes.

In the conventional developing cartridge 1 with the above-described structure, a toner image is formed on the photosensitive medium 11 during a printing operation. In other words, when receiving a printing order, a laser beam emitted from the light exposure unit is incident on the photosensitive medium 11 through the laser beam opening 21 so as to form an electrostatic latent image corresponding to printing data on the surface of the photosensitive medium 11. Then, the developing roller 15 supplies toner, which is supplied from the toner supplying roller 16, to the electrostatic latent image so as to develop the electrostatic latent image into a toner image. The toner image formed on the photosensitive medium 11 is transferred onto a printing medium by a transferring roller (not illustrated).

In the conventional developing cartridge 1, all parts used to form a toner image on the photosensitive medium 11, that is, the photosensitive medium 11, the charging roller 13, the developing roller 15, and the toner supplying roller 16 are disposed in the lower frame 10.

If all parts used to form toner images are disposed in one frame such as the lower frame 10, it is inconvenient to maintain and repair the developing cartridge 1.

For example, when any part such as the charging roller 13, a used toner cleaner, etc, is damaged, it gives low maintenance cost to replace only the damaged charging roller 13 or used toner cleaner. However, since the conventional developing cartridge 1 cannot replace only the charging roller 13 or the used toner cleaner, the whole developing cartridge 1 is required to be replaced. Therefore, the conventional image forming apparatus requires a lot of maintenance costs.

Furthermore, although the charging roller 13 or used toner cleaner can be replaced, the structure is complex so that users cannot replace there items themselves.

SUMMARY OF THE INVENTION

The present general inventive concept provides a developing cartridge in that a charging member can be easily replaced, an image forming apparatus with the same, and a maintenance method of the developing cartridge.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept can substantially be achieved by providing a developing cartridge, which includes a main frame including a photosensitive medium, and a charging member frame including a charging member to charge the photosensitive medium and detachably disposed at the main frame.

The main frame includes at least one frame reference groove or frame reference projection, and the charging member frame includes at least one frame reference projection or frame reference groove to be inserted into the at least one frame reference groove of the main frame. The at least one frame reference groove may be formed in substantially a semicircle, and the at least one frame reference projection may be formed in substantially a semicircle corresponding to the at least one frame reference groove.

The charging member includes; a charging roller; and a pair of charging roller holders configured in that one end of each of the charging roller holders supports a shaft of the charging roller and the other end of each of the charging roller holders is hinge-connected to the charging member frame. Also, the developing cartridge may further include an elastic member disposed between the charging roller holder and the charging member frame.

The charging member frame may further include a charging member cleaner to clean the charging member or a charge eliminating member to eliminate charges of the photosensitive medium.

Furthermore, the developing cartridge may further include a used toner cleaner to remove used toner from the photosensitive medium with at least one cleaner reference hole. The main frame includes at least one cleaner reference projection corresponding to the at least one cleaner reference hole.

The used toner cleaner may include a used toner bracket fixed to the main frame or the charging member frame, and provided with the at least one cleaner reference hole, and a cleaning blade fixed to the used toner bracket and to remove used toner from the photosensitive medium.

The main frame can include at least one frame reference groove so that a user is able to hold the used toner bracket by a hand.

The foregoing and/or other aspects and utilities of the present general inventive concept can also be achieved by providing a developing cartridge including a developing frame including a photosensitive medium a used toner frame to store used toner to be removed from the photosensitive medium, a charging member frame including a charging member to charge the photosensitive medium and detachably disposed at the used toner frame, and left and right side plates detachably disposed at the left side and the right side of the developing frame and the used toner frame to couple the developing frame and the used toner frame.

The used toner frame may further include a used toner cleaner to remove used toner from the photosensitive medium with at least one cleaner reference hole. The used toner frame further including at least one cleaner reference projection corresponding to the at least one cleaner reference hole.

The used toner cleaner includes: a used toner bracket fixed to the used toner frame or the charging member frame, and provided with the at least one cleaner reference hole; and a cleaning blade fixed to the used toner bracket and to remove used toner from the photosensitive medium.

Also, the used toner frame includes at least one frame reference groove so that a user is able to hold the used toner bracket by a hand.

The foregoing and/or other aspects and utilities of the present general inventive concept can also be achieved by providing an image forming apparatus including a printing medium feeding unit to feed a printing medium; a developing cartridge to form an image corresponding to printing data on a photosensitive medium, the developing cartridge including; a developing frame comprising the photosensitive medium; a used toner frame to store used toner to be removed from the photosensitive medium; a charging member frame including a charging member to charge the photosensitive medium and detachably disposed at the used toner frame; and left and right side plates detachably disposed at the left side and the right side of the developing frame and the used toner frame to couple the developing frame and the used toner frame; a transferring roller disposed to rotate in contact with the photosensitive medium and to transfer the image on the photosensitive medium onto the printing medium fed from the printing medium feeding unit; and a discharging unit to discharge the printing medium having the image formed.

The foregoing and/or other aspects and utilities of the present general inventive concept can also be achieved by providing a maintenance method of a developing cartridge including of separating a charging member frame at which a charging member is disposed from a main frame, and fixing a new charging member frame to the main frame.

Also, a maintenance method of a developing cartridge includes separating a charging member frame from a main frame, maintaining at least one of a charging member, a charging member cleaner, and a charge eliminating member that are disposed at the separated charging member frame, and fixing the charging member frame having been maintained at the main frame.

When fixing the charging member frame to the main frame, at least one frame reference projection or frame reference groove formed at the charging member frame may be inserted into at least one frame reference groove or frame reference projection formed at the main frame.

The foregoing and/or other aspects and utilities of the present general inventive concept can also be achieved by providing a maintenance method of a developing cartridge including separating a charging member frame at which a charging member is disposed from a main frame, separating a used toner cleaner from at least one cleaner reference projection of the main frame, assembling a new used toner cleaner to the main frame by inserting at least one cleaner reference hole of the new used toner cleaner into the at least one cleaner reference projection, and fixing the charging member frame to the main frame.

When assembling the new used toner cleaner to the main frame, a user may hold the used toner cleaner by a hand through the at least one frame reference groove.

The foregoing and/or other aspects and utilities of the present general inventive concept can also be achieved by providing a charging member frame detachably disposed at a main frame of a developing cartridge including a pair of charging roller holders including one end of each of the charging roller holders to be hinge-connected to the charging member frame, and a charging roller rotatably disposed at the other end of each of the charging roller holders.

The foregoing and/or other aspects and utilities of the present general inventive concept can also be achieved by providing a pair of charging roller holders of a developing cartridge including one end of each of the charging roller holders to rotatably support a charging roller, and the other end of each of the charging roller holders to be hinge-connected to a charging member frame, wherein the charging member frame is detachably disposed at a main frame of the developing cartridge, and wherein when the charging member frame is disposed at the main frame of the developing cartridge, the pair of charging roller holders allows the charging roller to contact a photosensitive medium of the developing cartridge.

The foregoing and/or other aspects and utilities of the present general inventive concept can also be achieved by providing a charging roller of a developing cartridge including a pair of charging roller holders to be hinge-connected to a charging member frame to rotatably support the charging roller, wherein the charging member frame is detachably disposed at a main frame of the developing cartridge, and wherein when the charging member frame is disposed at the main frame of the developing cartridge, the pair of charging roller holders allows the charging roller to contact with a photosensitive medium of the developing cartridge.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
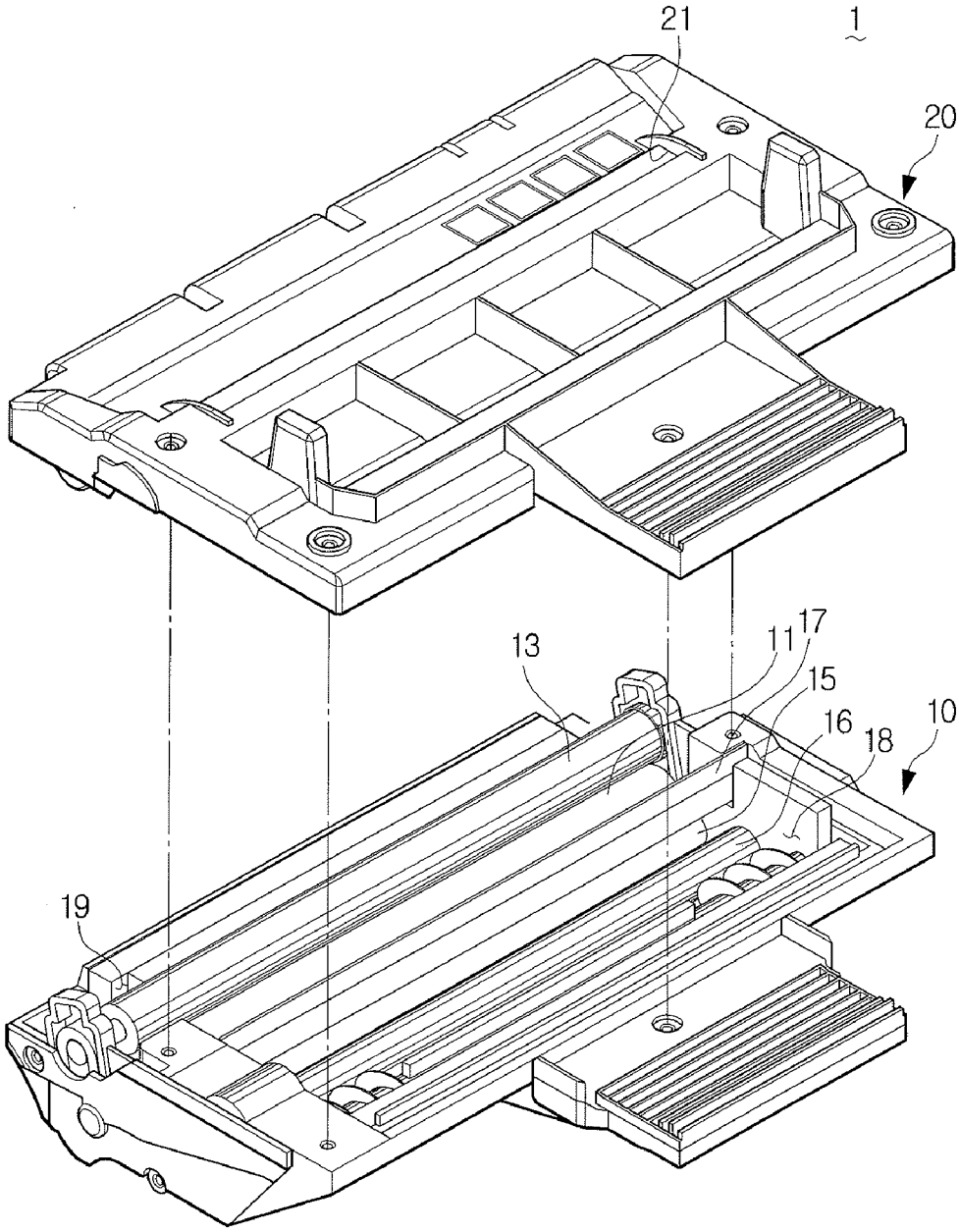
FIG. 1 (PRIOR ART)
FIG. 1 is an exploded perspective view illustrating a conventional developing cartridge.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The matters defined in the description, such as a detailed construction and elements thereof, are provided to assist in a comprehensive understanding of the general inventive concept. Thus, it is apparent that the general inventive concept may be carried out without those defined matters. Also, well-known functions or constructions are omitted to provide a clear and concise description of exemplary embodiments herein.

Figure 2:
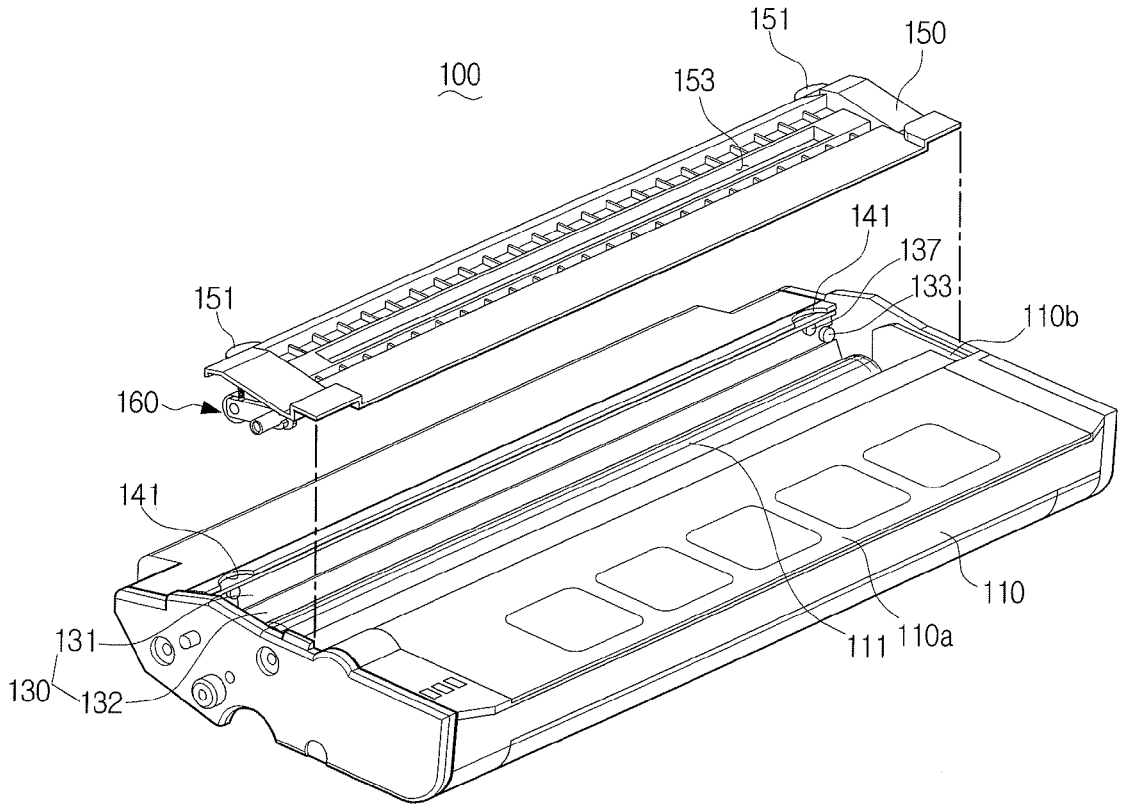
FIG. 2 is an exploded perspective view illustrating a developing cartridge according to an embodiment of the present general inventive concept.
Figure 3:
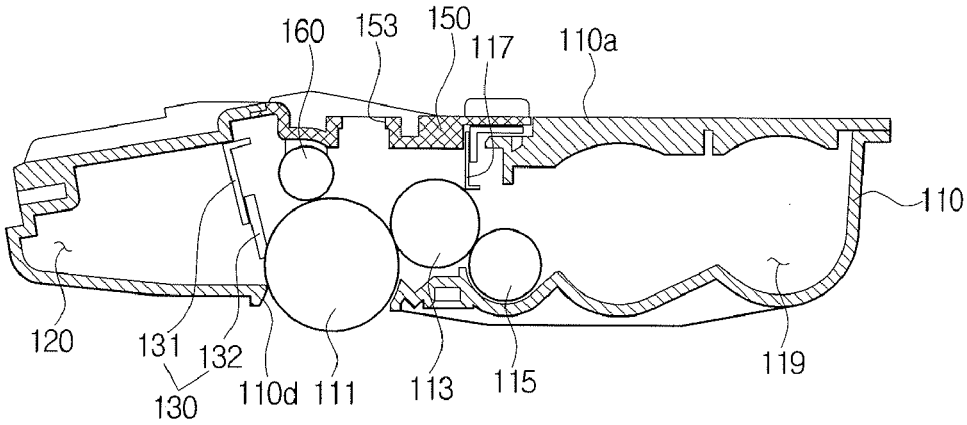
FIG. 3 is a sectional view schematically illustrating the developing cartridge of FIG. 2.
Figure 4:
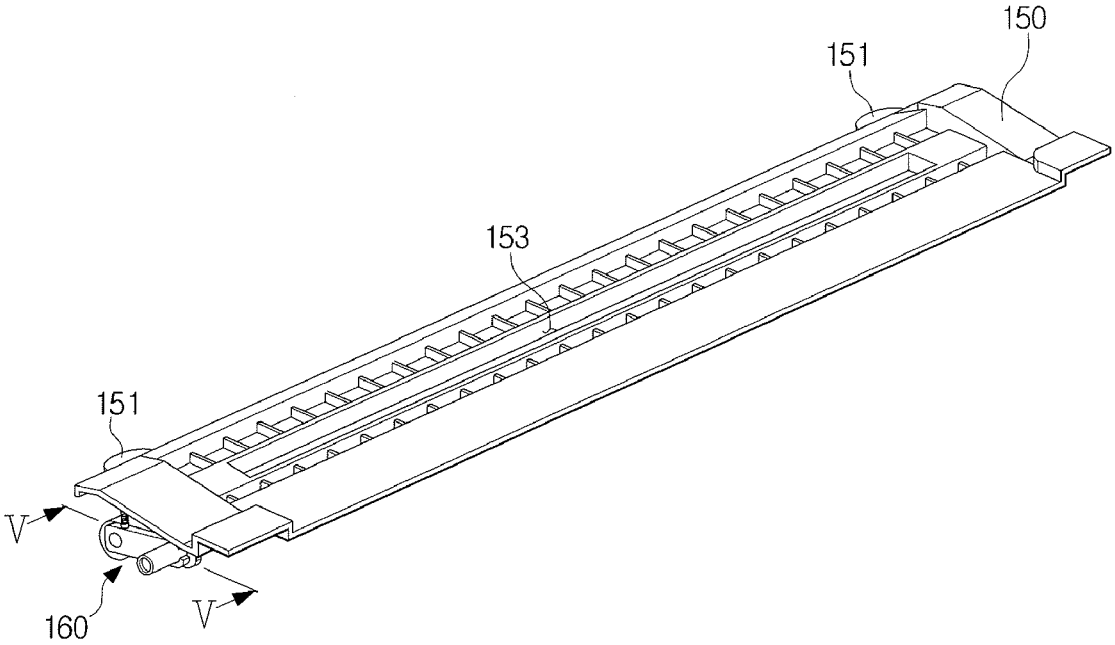
FIG. 4 is a perspective view illustrating a charging member frame of the developing cartridge of FIG. 2 in which a charging member is disposed.

FIG. 2 is an exploded perspective view illustrating a developing cartridge according to an embodiment, and FIG. 3 is a sectional view schematically illustrating the developing cartridge of FIG. 2.

Referring to FIG. 2, a developing cartridge 100 according to an embodiment includes a main frame 110 and a charging member frame 150 that is detachably disposed in the main frame 110.

Referring to FIGS. 2 and 3, the main frame 110 includes a photosensitive medium 111, a developing roller 113, a toner supplying roller 115, and a used toner cleaner 130.

The main frame 110 is formed in a substantially hexahedral shape. On an upper surface 110*a* of the main frame 110 is formed a charging member assembly opening 110*b* in which a charging member frame 150 is assembled. Also, at least one frame reference groove 141 may be formed in the upper surface 110*a* of the main frame 110 at a side of the charging member assembly opening 110*b*. In this exemplary embodiment, two frame reference grooves 141 are formed in the upper surface 110*a* of the main frame 110 and have a substantially semicircular shape. The shape of the frame reference grooves 141 according to this embodiment is only one example, and the frame reference groove 141 may be formed in various shapes.

The photosensitive medium 111 has a cylindrical shape and is rotatably disposed at the main frame 110. A laser beam emitted from a light exposure unit 380 (refer to FIG. 10) forms a predetermined electrostatic latent image on the photosensitive medium 111. Some part of the photosensitive medium 111 is exposed to the outside of the main frame 110 through a photosensitive medium opening 110*d* formed at a lower surface of the main frame 110.

The developing roller 113 is rotatably disposed at the main frame 110 at a side of the photosensitive medium 111 to carry toner to the photosensitive medium 111. A toner regulating member 117 is disposed to be in contact with a surface of the developing roller 113 at a side of the developing roller 113 at the main frame 110. The toner regulating member 117 forces toner that is conveyed onto the developing roller 113 by the toner supplying roller 115 to be regulated into a thin toner layer and charged.

The toner supplying roller 115 is rotatably disposed at a side of the developing roller 113 at the main frame 110 to carry toner that is stored at a toner storing space 119 onto the developing roller 113.

The toner storing space 119 is formed at a side of the toner supplying roller 115 at the main frame 110 to store a predetermined amount of toner. A toner agitator (not illustrated) may be disposed in the toner storing space 119 in order to prevent toner from being hardened.

The used toner cleaner 130 is disposed at the main frame 110 in contact with the photosensitive medium 111 opposite to the developing roller 113 in order to scrape off used toner that has failed to be transferred and accordingly remains on the photosensitive medium 111 after a toner image is transferred onto a printing medium. The used toner cleaner 130 includes a used toner bracket 131 and a cleaning blade 132.

The used toner bracket 131 is fixed at the main frame 110 using securing elements 133 such as bolts. Therefore, the used toner bracket 131 is provided with a plurality of fixing holes (refer to 234 in FIG. 8) through which the securing elements 133 are inserted. In this embodiment, the used toner bracket 131 has two fixing holes at opposite sides and two tap holes (refer to 235 in FIG. 8) through which the securing elements 133 are secured are formed at positions of the main frame 110 corresponding to the fixing holes.

Figure 8:
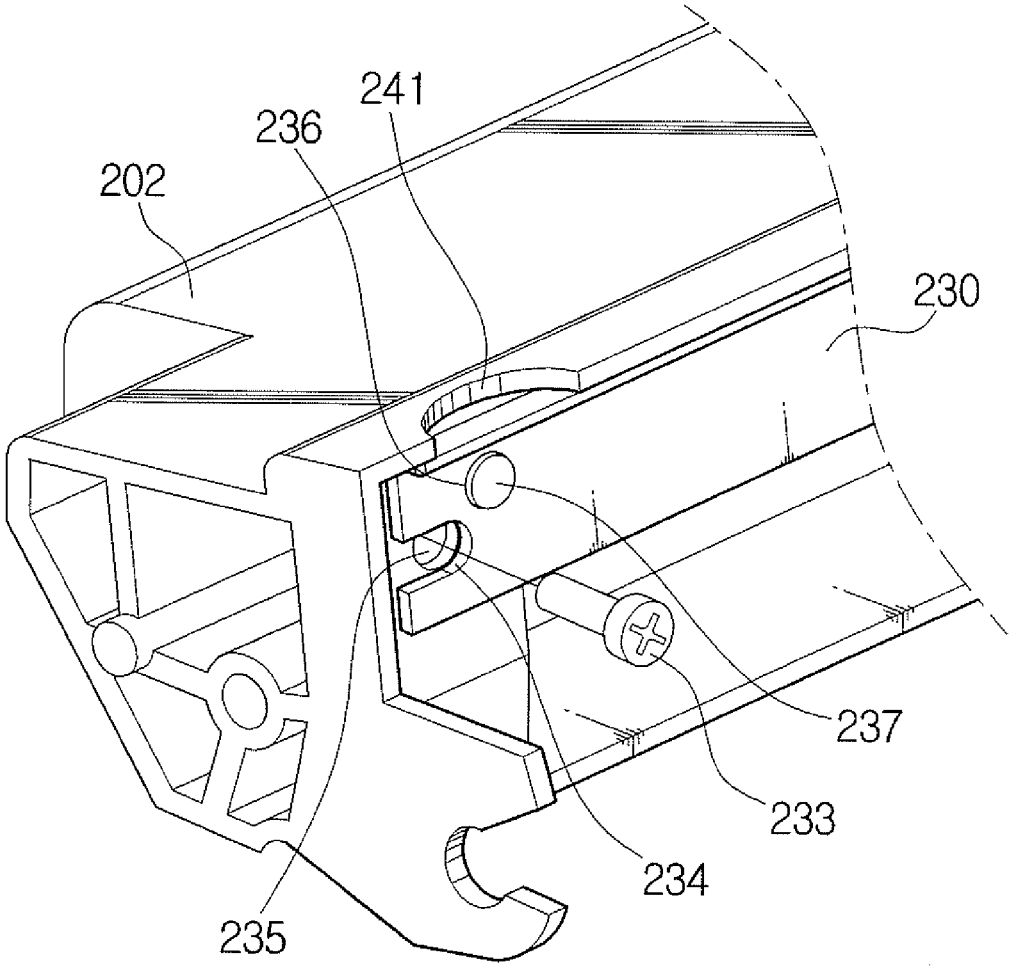
FIG. 8 is a partially enlarged perspective view illustrating a part of a used toner frame of the FIG. 7.

Also, the used toner bracket 131 may further have at least one cleaner reference hole (refer to 235 in FIG. 8). The at least one cleaner reference hole holds the used toner bracket 131 not to move while fixing the used toner bracket 131 to the main frame 110 using the securing elements 133. In this exemplary embodiment, two cleaner reference holes are formed near the two fixing holes of the used toner bracket 131, and two cleaner reference projections 137 are formed at positions of the main frame 110 corresponding to the cleaner reference holes. The two cleaner reference projections 137 are formed in substantially a pin shape.

Meanwhile, the above-described frame reference grooves 141 of the main frame 110 may be formed over the two cleaner reference projections 137, as illustrated in FIG. 2. Then, it is convenient to insert the cleaner reference projections 137 of the main frame 110 into the cleaner reference holes of the used toner bracket 131. Also, each of the plurality of frame reference grooves 141 may have a size such that when assembling the used toner bracket 131, a user's hand can access through the frame reference groove 141 to hold the used toner bracket 131. If a user holds the used toner bracket 131 by a hand via the frame reference grooves 141 and fixes the used toner bracket 131 to the main frame 110 using the securing elements 133, an assembling operation is very convenient.

The cleaning blade 132 is fixed to the used toner bracket 131 in contact with the surface of the photosensitive medium 111 to remove the used toner from the photosensitive medium 111. Therefore, the cleaning blade 132 may be formed of a rubber material so as to remove the used toner without damaging the surface of the photosensitive medium 111.

In the above description, the used toner cleaner 130 is configured of the used toner bracket 131 and the cleaning blade 132. Alternatively, a used toner cleaner (not illustrated) may be formed in a single part. In this case, a plurality of cleaner reference holes and fixing holes can be formed at the used toner cleaner 130 formed as a single part. In addition, in the above description, the used toner bracket 131 of the used toner cleaner 130 is disposed at the main frame 110. Although not illustrated, the used toner bracket 131 of the used toner cleaner 130 may alternatively be disposed at the charging member frame 150.

A used toner storing space 120 is formed at a side of the used toner cleaner 130 at the main frame 110 to store the used toner removed from the photosensitive medium 111 by the used toner cleaner 130. Therefore, the used toner storing space 120 is formed opposite to the toner storing space 119 with respect to the photosensitive medium 111.

The charging member frame 150 is detachably disposed at the charging member assembly opening 110*b* formed at the upper surface 110*a* of the main frame 110. The charging member frame 150 includes a charging member 160 that charges the surface of the photosensitive medium 111 by a predetermined voltage. Therefore, both of the charging member frame 150 and the charging member 160 may form one module or one unit.

The charging member frame 150 is formed in a shape corresponding to the above-described charging member assembly opening 110*b*. At a side of the charging member frame 150 is formed at least one frame reference projection 151 with a size and shape each corresponding to the at least one frame reference groove 141 of the main frame 110, respectively. In this embodiment, the charging member frame 150 has two substantially semicircular frame reference projections 151 corresponding to the two frame reference grooves 141. The at least one frame reference projection and groove 151 and 141, respectively, prevent the charging member frame 150 from sliding with respect to the main frame 110.

Figure 6:
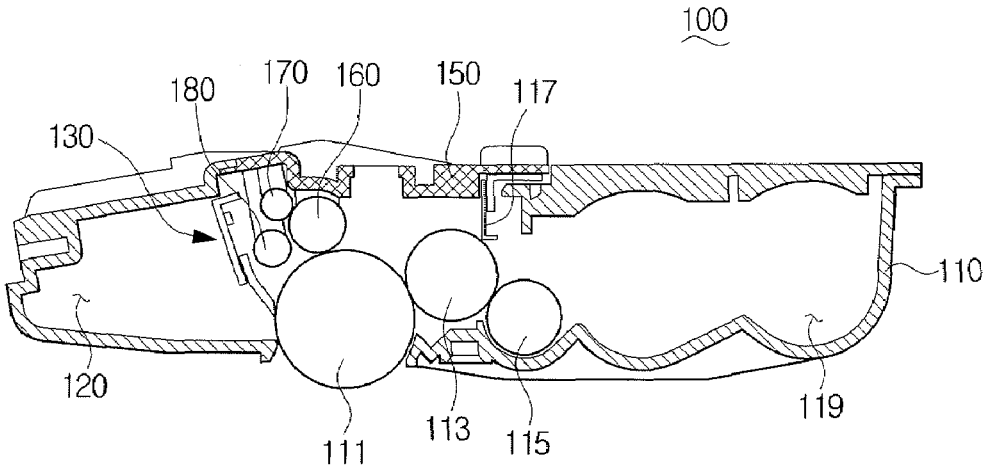
FIG. 6 is a sectional view illustrating a developing cartridge according to an embodiment including a charging member frame in which a charge eliminating member, a charging roller, and a charging member cleaner are disposed.

Furthermore, the charging member frame 150 is provided with a laser beam opening 153 through which a laser beam emitted from the light exposure unit 380 (refer to FIG. 10) passes. The laser beam opening 153 is formed not to interfere with the charging member 160 disposed at the charging member frame 150. When a charging member cleaner 170 and a charge eliminating member 180 are disposed on the charging member frame 150 as illustrated in FIG. 6, the laser beam opening 153 is formed not to interfere with them.

Figure 5:
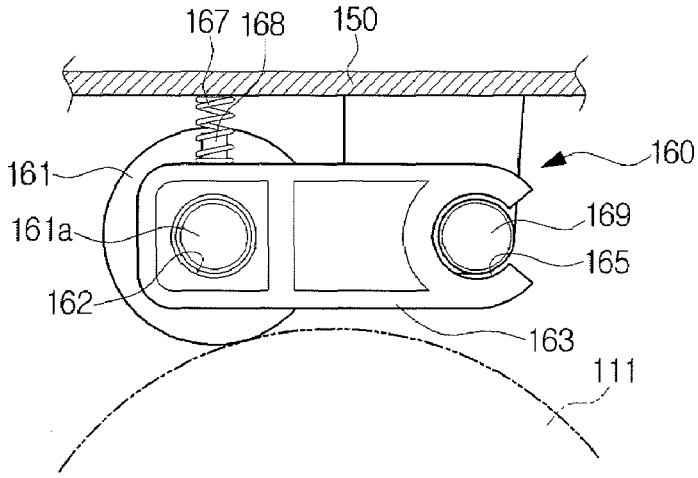
FIG. 5 is a sectional view illustrating the charging member frame of FIG. 4 taken along a line V-V in FIG. 4.

Referring to FIG. 5, the charging member 160 can include a charging roller 161 and a pair of charging roller holders 163.

The charging roller 161 is in contact with the surface of the photosensitive medium 111 and applies a predetermined voltage to the surface of the photosensitive medium 111. The charging roller 161 is electrically connected with a charging roller electric power part (not illustrated) to supply the charging roller 161 with a predetermined voltage.

The pair of charging roller holders 163 support opposite ends of a shaft 161 a of the charging roller 161, thereby allowing the charging roller 161 to pivot by a predetermined angle with respect to the charging roller frame 150. At one end of the charging roller holder 163 is formed a shaft hole 162 that rotatably supports the shaft 161*a* of the charging roller 161, and at the other end of the charging roller holder 163 is formed a hinge hole 165 that is hinge-connected to the charging member frame 150. A hinge shaft 169 that is inserted into the hinge hole 165 is formed at the charging member frame 150. As a result, the charging roller 161 can pivot on the hinge shaft 169 by a predetermined angle with respect to the charging member frame 150.

Meanwhile, an elastic member 167 may be disposed between each of the charging roller holders 163 and the charging member frame 150 as illustrated in FIG. 5. The elastic member 167 allows the charging roller 161 to stably remain in contact with the photosensitive medium 111 when the photosensitive medium 111 rotates. In this embodiment, a coil spring is used as the elastic member 167. In this case, the charging roller frame 150 may be provided with an elastic member fixing part 168 at which the elastic member 167 is fixed.

In addition, as illustrated in FIG. 6, the charging member cleaner 170 to clean a surface of the charging member 160 and the charge eliminating member 180 to eliminate voltage that remains on the photosensitive medium 111 may be disposed at the charging member frame 150. In other words, the charging member frame 150, the charging member 160, the charging member cleaner 170, and the charge eliminating member 180 may be formed as one module or one unit in order to be separated as a single part from the main frame 110 of the developing cartridge 100. In this case, the charging member cleaner 170 and the charge eliminating member 180 may be detachably disposed at the charging member frame 150 without any relation to the charging member 160.

In the above description, the at least one frame reference groove 141 is formed at the main frame 110, and the at least one frame reference projection 151 corresponding to the frame reference groove 141 is formed at the charging member frame 150. Alternatively, although not illustrated, at least one frame reference projection 151 may be formed at the main frame 110, and at least one frame reference groove 141 corresponding to the frame reference projection 151 may be formed at the charging member frame 150.

Hereinafter, a maintenance method of a developing cartridge 100 according to an embodiment with the above-described structure will be explained with reference to FIGS. 2 and 3.

Here, the maintenance of the developing cartridge 100 includes the cases that the charging member frame 150 and charging member 160 are totally replaced, that only the charging member 160 disposed at the charging member frame 150 is replaced, and that anyone of the charging member 160, the charging member cleaner 170, and the charge eliminating member 180 disposed at the charging member frame 150, as illustrated in FIG. 6, is replaced.

First, it is explained that the charging member frame 150 to form one module is replaced with a new charging member frame 150.

The charging member frame 150 at which the charging member 160 is disposed is separated from the main frame 110. Next, a new charging member frame 150 with a charging member 160 is fixed to the main frame 110. When fixing the new charging member frame 150 to the main frame 110, the at least one frame reference projection 151 formed at the charging member frame 150 is inserted into the at least one frame reference groove 141 formed at the main frame 110, and then, the charging member frame 150 is fixed to the main frame 110. When assembling the charging member frame 150 on the main frame 110, usage of the at least one frame reference projection and groove 151 and 141 allows accurate and convenient assembly operation.

In addition, when maintaining the charging member 160, etc., disposed at the charging member frame 150, the charging member frame 150 is separated from the main frame 110. Then, at least one of the charging member 160, the charging member cleaner 170, and the charge eliminating member 180 each disposed at the separated charging member frame 150 is maintained. In other words, a status of each of the charging member 160, the charging member cleaner 170, and the charge eliminating member 180 disposed at the charging member frame 150 is checked, and then anything damaged among those is replaced. In this case, if the charging member 160, the charging member cleaner 170, and the charge eliminating member 180 are detachably disposed at the charging member frame 150, separation and assembly thereof are very easy.

After the maintenance of the charging member 160, the charging member cleaner 170, and the charge eliminating member 180 is finished, the separated charging member frame 150 is again fixed to the main frame 110. At this time, the at least one frame reference projection 151 of the charging member frame 150 is inserted into the at least one of frame reference groove 141 of the main frame 110, and then the charging member frame 150 is fixed to the main frame 110.

Next is a description of replacing the used toner cleaner 130 disposed at the main frame 110.

The charging member frame 150 at which the charging member 160 is disposed is separated from the main frame 110. Then, the used toner cleaner 130 is separated from the at least one cleaner reference projection 137 of the main frame 110. If the used toner cleaner 130 is fixed to the main frame 110 by securing elements 133 such as bolts, the securing elements 133 are first unfastened and the used toner cleaner 130 is separated.

Next, a new used toner cleaner 130 is assembled to the main frame 110. In this time, if the at least one cleaner reference hole (refer to 236 in FIG. 8) formed at the new used toner cleaner 130 is slid over into the at least one cleaner reference projection 137 formed at the main frame 110, the assembly is very easy.

When fixing the used toner cleaner 130 to the main frame 110 by the securing elements 133, a user can hold the used toner cleaner 130 by a hand through anyone of the at least one frame reference groove 141 formed at the main frame 110 so that it is easy to fix the used toner cleaner 130 to the main frame 110.

After fixing the used toner cleaner 130, the charging member frame 150 is again fixed back to the main frame 110. In this case, if the at least one frame reference projection 151 of the charging member frame 150 is inserted into the at least one frame reference groove 141 of the main frame 110, the assembly is easy.

Figure 9:
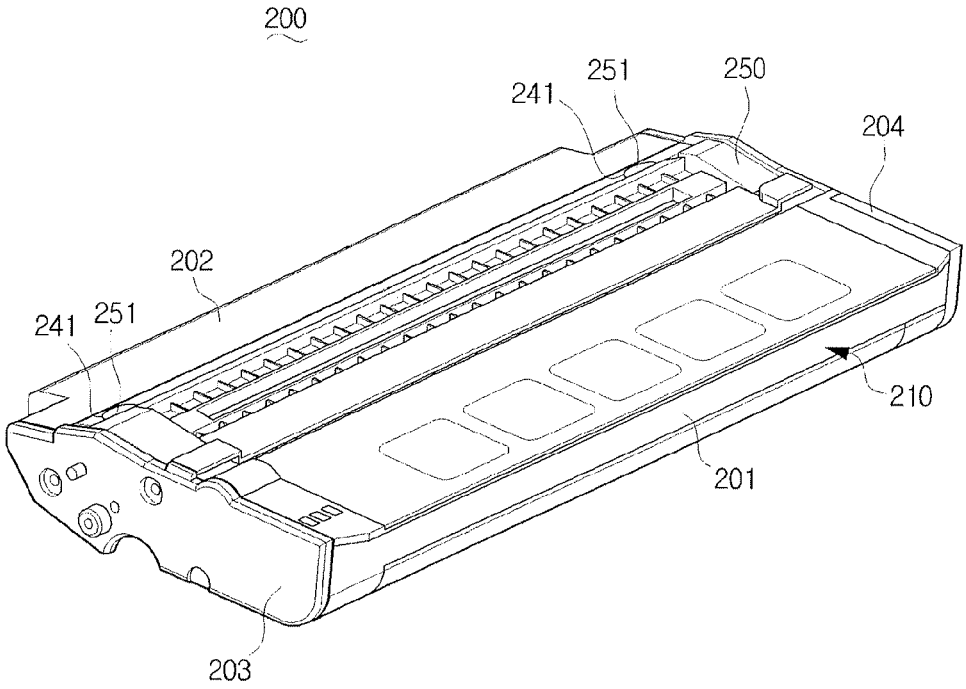
FIG. 9 is a perspective view illustrating the developing cartridge of FIG. 7, parts of which are assembled.

Hereinafter, a developing cartridge according to another embodiment will be explained with reference to FIGS. 7 to 9.

Figure 7:
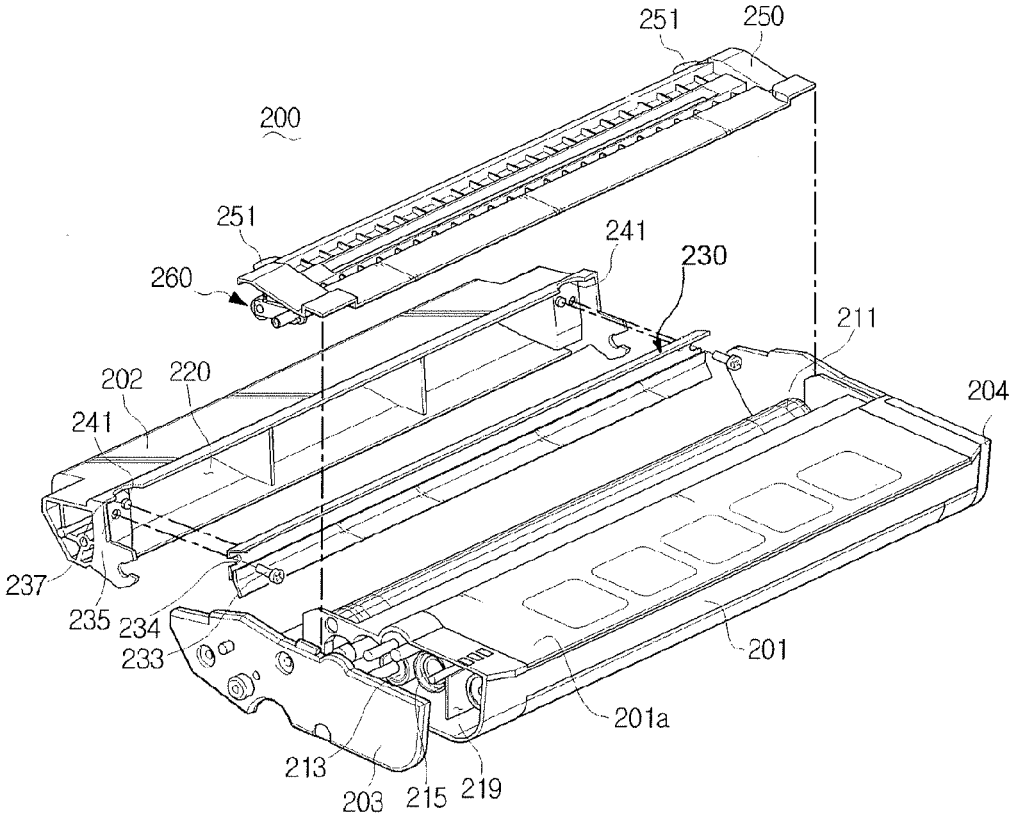
FIG. 7 is an exploded perspective view illustrating a developing cartridge according to another embodiment.

Referring to FIG. 7, a developing cartridge 200 according to another embodiment includes a developing frame 201, a used toner frame 202, a charging member frame 250, a left side plate 203, and a right side plate 204.

In this embodiment, the developing frame 201, the used toner frame 202, and the left and right side plates 203 and 204 form the main frame 110 of the above-described embodiment. In other words, to assembly the developing frame 201, the used toner frame 202, and the left and right side plates 203 and 204 forms a main frame 210 corresponding to the main frame 110 of the above-described embodiment.

The developing frame 201 is provided with a photosensitive medium 211, and holds toner for developing an electrostatic latent image formed on the photosensitive medium 211. Also, the developing frame 201 is provided with a developing roller 213, a toner supplying roller 215, and a toner regulating member for supplying toner to the photosensitive medium 211. A toner storing space 219 in which a predetermined amount of toner is stored is formed in the developing frame 201. A toner agitator (not illustrated) may be disposed in the toner storing space 219. The photosensitive medium 211, the developing roller 213, the toner supplying roller 215, and the toner regulating member are similar to those of the developing cartridge 100 according to an embodiment as described above, and therefore detailed descriptions thereof are omitted.

On the other hands, the developing frame 201 may be provided with a detachable upper surface 201*a* so that it is easy to assemble the photosensitive medium 211, the developing roller 213, the toner supply roller 215, etc., inside the developing frame 201.

The used toner frame 202 stores the used toner being removed from the photosensitive medium 211, and includes a used toner cleaner 230 and a used toner storing space 220. At least one frame reference groove 241 and at least one cleaner reference projection 237 are formed at the used toner frame 202. The at least one frame reference groove 241 receives the at least one frame reference projection 251 formed at the charging member frame 250 so as to serve as a reference when mounting the charging member frame 250.

The at least one cleaner reference projection 237 is inserted into the at least one cleaner reference hole 236 formed at the used toner cleaner 230 as illustrated in FIG. 8, and serves to fix a mounting position of the used toner cleaner 230. The at least one frame reference groove 241 and cleaner reference projection 237 is similar to the frame reference groove 141 and the cleaner reference projection 137 of the developing cartridge 100 according to the above-described embodiment; so detailed descriptions thereof are omitted.

Furthermore, the used toner cleaner 230 is provided with fixing holes 234 for fixing the used toner cleaner 230 to the used toner frame 202 as illustrated in FIG. 8. The used toner frame 202 is provided with tap holes 235 that correspond to the fixing holes 234, and in which securing elements 233 are fastened in. In this embodiment, the used toner cleaner 230 has two fixing holes 234, and the used toner frame 202 has two tap holes 235.

The charging member frame 250 includes a charging member 260 to charge a surface of the photosensitive medium 211 and is detachably disposed at the used toner frame 202. The charging member frame 250 is fixed to the used toner frame 202 by the left and right side plates 203 and 204. In this case, the at least one frame reference projection 251 of the charging member frame 250 is inserted into the frame reference groove 241 of the used toner frame 202 so that the charging member frame 250 is fixed not to move with respect to the used toner frame 202. The charging member frame 250 and the charging member 260 are similar to the charging member frame 150 and the charging member 160 of the developing cartridge 100 according to the above-described embodiment; so detailed descriptions thereof are omitted.

In the above description, the at least one frame reference groove 241 is formed at the used toner frame 202, and the at least one frame reference projection 251 corresponding to the frame reference groove 241 is formed at the charging member frame 250. Alternatively, although not illustrated, at least one frame reference projection may be formed at the used toner frame 202, and at least one frame reference groove corresponding to the frame reference projection may be formed at the charging member frame 250.

The left side plate 203 and the right side plate 204 serve the developing frame 201 and the used toner frame 202 to be coupled. Therefore, the developing frame 201 and the used toner frame 202 coupled with the left and right side plates 203 and 204 form one main frame 210 as illustrated in FIG. 9. The left and right side plates 203 and 204 are detachably disposed at the left and right sides of the developing frame 201 and the used toner frame 202, respectively, so as to couple the developing frame 201 and the used toner frame 202. The left and right side plates 203 and 204 support a shaft of the photosensitive medium 211, a shaft of the developing roller 213, and a shaft of the toner supplying roller 215 at opposites ends thereof so that the photosensitive medium 211, the developing roller 213, and the toner supplying roller 215 can rotate inside the developing frame 201.

The developing cartridge 200 according to this embodiment has the same operation and maintenance method as those of the developing cartridge 100 according to the above-described embodiment, except that the main frame 210 has a structure to be disassembled into the developing frame 201, the used toner frame 202, and the left and right side plates 203 and 204. Therefore, detailed descriptions of operation and maintenance method of the developing cartridge 200 are omitted.

Figure 10:
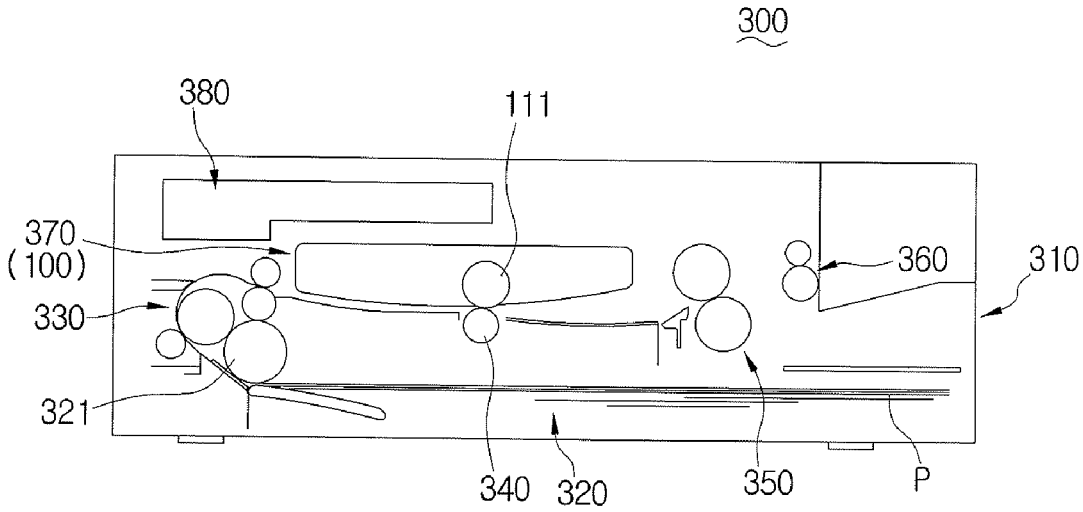
FIG. 10 is a sectional view schematically illustrating an image forming apparatus having a developing cartridge according to an embodiment.

Hereinafter, an image forming apparatus with a developing cartridge according to an embodiment will be explained with reference to FIG. 10.

An image forming apparatus 300 according to an embodiment includes a main body frame 310, a printing medium feeding unit 320, a conveying roller unit 330, a light exposure unit 380, a developing cartridge 370, a fixing unit 350, and a discharging unit 360.

The main body frame 310 forms an appearance of the image forming apparatus 300. The printing medium feeding unit 320, the conveying roller unit 330, the developing cartridge 370, a transferring roller 340, the fixing unit 350, and the discharging unit 360 are disposed inside the main body frame 310.

The printing medium feeding unit 320 is disposed inside the main body frame 310, and holds a plurality of printing media P. A pickup roller 321 that picks up and feeds the stored printing media P one by one is disposed at a front end of the printing medium feeding unit 320.

The conveying roller unit 330 includes at least one pair of conveying rollers, and conveys a printing medium P picked up by the printing medium feeding unit 320 to between the transferring roller 340 and the photosensitive medium 111.

The light exposure unit 380 is disposed over the developing cartridge 370 and emits a laser beam corresponding to printing data.

The developing cartridge 370 develops an electrostatic latent images formed by the laser beam emitted from the light exposure unit 380 into a toner image, and has a similar structure to the developing cartridge 100 according to embodiments as described above; so a detailed description thereof is omitted.

The transferring roller 340 is disposed to rotate in contact with the photosensitive medium 111 of the developing cartridge 370, and causes the toner image formed on the photosensitive medium 111 to be transferred onto a printing medium P to be conveyed from the printing medium feeding unit 320.

The fixing unit 350 includes a pressure roller and a heat roller, and applies pressure and heat to the printing medium to pass through between the pressure roller and the heat roller so that the toner image is fixed onto the printing medium.

The discharging unit 360 discharges the printing medium onto which the toner image is fixed when passing through the fixing unit 350 outside the image forming apparatus 300.

Hereinafter, an operation of the image forming apparatus 300 having the above-described structure will be explained with reference to FIG. 10. However, the developing cartridge 370 of FIG. 10 will be explained with reference to the developing cartridge 100 as illustrated in FIG. 3.

When receiving a printing command, the image forming apparatus 300 applies a voltage to the charging member 160 of the developing cartridge 100 to charge the surface of the photosensitive medium 111 by a predetermined voltage, and causes the photosensitive medium 111 to rotate.

At substantially the same time, the light exposure unit 380 operates to emit a laser beam corresponding to printing data. The laser beam emitted from the light exposure unit 380 is incident on the photosensitive medium 111 through the laser beam opening 153 formed at the charging member frame 150 of the developing cartridge 100, and then forms an electrostatic latent image corresponding to the printing data on the surface of the photosensitive medium 111 charged by the charging member 160.

When the photosensitive medium 111 continues to rotate, the electrostatic latent images on the photosensitive medium 111 moves to a position to face the developing roller 113. On a surface of the developing roller 113 is formed a charged toner layer. In other words, the toner supplying roller 115 supplies the developing roller 113 with toner to be stored in the toner storing space 119. When the developing roller 113 rotates, the toner moved onto the developing roller 113 is regulated into a charged thin toner layer by the toner regulating member 117. Therefore, when the photosensitive medium 111 rotates the electrostatic latent images to face the developing roller 113, toner of the toner layer formed on the surface of the developing roller 113 moves onto the surface of the photosensitive medium 111 to develop the electrostatic latent image into a toner image.

On the other hand, when receiving the printing command, the printing medium feeding unit 320 picks up a printing medium P and feeds it to the conveying roller unit 330. The conveying roller unit 330 conveys the picked-up printing medium P between the photosensitive medium 111 of the developing cartridge 100 and the transferring roller 340.

When the printing medium P enters between the transferring roller 340 and the photosensitive medium 111 of the developing cartridge 100, the toner image on the rotating photosensitive medium 111 is transferred onto the printing medium P.

When the photosensitive medium 111 continues to rotate, the used toner cleaner 130 removes used toner that remains on the surface of the photosensitive medium 111 after the toner image is transferred to the printing medium P. The used toner removed from the photosensitive medium 111 is stored in the used toner storing space 120 formed in the main frame 110.

When the photosensitive medium 111 continues to rotate, an area of the photosensitive medium 111 in which the used toner is removed moves to a position to face the charging member 160 so that the area is recharged by a predetermined voltage by the charging member 160. If the developing cartridge 100 has the charge eliminating member 180 between the used toner cleaner 130 and the charging member 160, the charge eliminating member 180 completely removes any voltage that may remain on the surface of the photosensitive medium 111.

The photosensitive medium 111 to be charged by a predetermined voltage repeats the above procedure to transfer a toner image to a printing medium P.

The printing medium P onto which the toner image is transferred from the photosensitive medium 111 of the developing cartridge 100 is moved to the fixing unit 350. When the printing medium P passes between the pressure roller and the heat roller of the fixing unit 350, the toner image is fixed onto the printing medium P.

The printing medium P having the toner image fixed is then discharged outside the image forming apparatus 300 via the discharging unit 360.

With a developing cartridge according to an embodiment as described above, a charging member frame and a charging member disposed at the charging member frame forms one charging member module or one charging member unit, and the charging member module/unit has a structure to be separated from a main frame. Therefore, in order to replace or maintain the charging member, only the charging member module/unit is required to be separated from the main frame so that it is easy to replace or maintain the charging member.

With a developing cartridge according to various embodiments described above, a charging member, a charging member cleaner, and a charge eliminating member may be disposed at a charging member frame so as to form one module or one unit. The charging member, the charging member cleaner, and the charge eliminating member are freely detachably disposed at the charging member frame. Therefore, it is convenient to maintain/repair the charging member, the charging member cleaner, and the charge eliminating member.

In addition, because a developing cartridge according to the various embodiments is provided with a charging member configured as a module, it is not required to replace a whole developing cartridge for replacing only a charging member. Therefore, an image forming apparatus with a developing cartridge according to various embodiments can decrease a cost for maintaining/repairing the developing cartridge.

Also, with a developing cartridge according to various embodiments, when assembling a used toner cleaner to a main frame, a plurality of cleaner reference holes and cleaner reference projections are used. Therefore, assembly is very easy.

Furthermore, because a developing cartridge according to various embodiments is provided with a plurality of frame reference grooves formed at a main frame and a plurality of frame reference projections formed at a charging member frame, it is easy to assemble the charging member frame to the main frame. Therefore, it is convenient to maintain the developing cartridge.

Additionally, the charging member frame is fixed to the main frame using the plurality of frame reference grooves and projections so that when the developing cartridge is shaken, the charging member frame does not slide and move with respect to the main frame. Therefore, a position of a laser beam opening through which a laser beam emitted from a light exposure unit passes is not shifted due to shaking of the developing cartridge so that the laser beam is not blocked.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing cartridge comprising:

a main frame comprising a photosensitive medium; and a charging member frame detachably attached to the main frame and comprising:

a laser beam through-hole through which a laser beam passes through the charging member frame to form an image on the photosensitive medium; and a charging member to charge the photosensitive medium and detachably disposed at the main frame.

2. The developing cartridge of claim 1, wherein the main frame comprises at least one frame reference groove or frame reference projection, and the charging member frame comprises at least one frame reference projection or frame reference groove to be inserted into the at least one frame reference groove or frame reference projection of the main frame.

3. The developing cartridge of claim 2, wherein the at least one frame reference groove is formed in a substantially semicircle, and the at least one frame reference projection is formed in a substantially semicircle corresponding to the at least one frame reference groove.

4. The developing cartridge of claim 1, wherein the charging member comprises;

a charging roller; and a pair of charging roller holders configured in that one end of each of the charging roller holders supports a shaft of the charging roller and the other end of each of the charging roller holders is hinge-connected to the charging member frame.

5. The developing cartridge of claim 4, further comprising:

an elastic member disposed between the charging roller holders and the charging member frame.

6. The developing cartridge of claim 1, wherein the charging member frame further comprises a charging member cleaner to clean the charging member.

7. The developing cartridge of claim 6, wherein the charging member frame further comprises a charge eliminating member to eliminate charges of the photosensitive medium.

8. The developing cartridge of claim 1, further comprising:

a used toner cleaner to remove used toner from the photosensitive medium with at least one cleaner reference hole, wherein the main frame comprises at least one cleaner reference projection corresponding to the at least one cleaner reference hole.

9. The developing cartridge of claim 8, wherein the used toner cleaner comprises:

a used toner bracket fixed to the main frame or the charging member frame and provided with the at least one cleaner reference hole; and a cleaning blade fixed to the used toner bracket and to remove used toner from the photosensitive medium.

10. The developing cartridge of claim 9, wherein the main frame comprises at least one frame reference groove so that a user is able to hold the used toner bracket by a hand.

11. A developing cartridge comprising:

a developing frame comprising a photosensitive medium;

a used toner frame to store used toner to be removed from the photosensitive medium;

a charging member frame detachably attached to the developing frame and comprising a laser beam through-hole through which a laser beam passes through the charging member frame to form an image on the photosensitive medium, and a charging member to charge the photosensitive medium and detachably disposed at the used toner frame; and left and right side plates detachably disposed at the left side and the right side of the developing frame and the used toner frame to couple the developing frame and the used toner frame.

12. The developing cartridge of claim 11, wherein the used toner frame comprises at least one frame reference groove or frame reference projection; and the charging member frame comprises at least one frame reference projection or frame reference groove to be inserted into the at least one frame reference groove or frame reference projection of the used toner frame.

13. The developing cartridge of claim 12, wherein the at least one frame reference groove is formed in a substantially semicircle, and the at least one frame reference projection is formed in a substantially semicircle corresponding to the at least one frame reference groove.

14. The developing cartridge of claim 12, wherein the used toner frame further comprises a used toner cleaner to remove used toner from the photosensitive medium with at least one cleaner reference hole, and wherein the used toner frame further comprises at least one cleaner reference projection corresponding to the at least one cleaner reference hole.

15. The developing cartridge of claim 14, wherein the used toner cleaner comprises;

a used toner bracket fixed to the used toner frame or the charging member frame and provided with the at least one cleaner reference hole; and a cleaning blade fixed to the used toner bracket and to remove used toner from the photosensitive medium.

16. The developing cartridge of claim 15, wherein the used toner frame comprises at least one frame reference groove so that a user is able to hold the used toner bracket by a hand.

17. The developing cartridge of claim 11, wherein the charging member comprises;

a charging roller; and a pair of charging roller holders configured in that an end of each of the charging roller holders to support a shaft of the charging roller and the other end of each of the charging roller holder is hinge-connected to the charging member frame.

18. The developing cartridge of claim 17, further comprising;

an elastic member disposed between the charging roller holders and the charging member frame.

19. The developing cartridge of claim 11, wherein the charging member frame further comprises a charging member cleaner to clean the charging member.

20. The developing cartridge of claim 11, wherein the charging member frame further comprises a charge eliminating member to eliminate charges of the photosensitive medium.

21. An image forming apparatus comprising:

a printing medium feeding unit to feed a printing medium;

a developing cartridge to form an image corresponding to printing data on a photosensitive medium, the developing cartridge comprising;

a developing frame comprising the photosensitive medium;

a used toner frame to store used toner to be removed from the photosensitive medium;

a charging member frame detachably attached to the developing frame and comprising a laser beam through-hole through which a laser passes through the charging member frame, and a charging member to charge the photosensitive medium and detachably disposed at the used toner frame; and left and right side plates detachably disposed at the left side and the right side of the developing frame and the used toner frame to couple the developing frame and the used toner frame;

a transferring roller disposed to rotate in contact with the photosensitive medium and to transfer the image on the photosensitive medium onto the printing medium fed from the printing medium feeding unit; and a discharging unit to discharge the printing medium having the image formed.

22. A charging member frame detachably disposed at a main frame of a developing cartridge, the charging member frame comprising:

a pair of charging roller holders including one end of each of the charging roller holders to be hinge-connected to the charging member frame; and a charging roller rotatably disposed at the other end of each of the charging roller holders.

23. The charging member frame of claim 22, wherein an elastic member is disposed between the charging roller holders and the charging member frame.

24. The charging member frame of claim 22, further comprising at least one frame reference projection or frame reference groove;

wherein a main frame of the developing cartridge comprises at least one frame reference groove or frame reference projection into which the at least one frame reference projection or frame reference groove is inserted.

25. The charging member frame of claim 24, wherein the at least one frame reference groove is formed in a substantially semicircle, and the at least one frame reference projection is formed in a substantially semicircle corresponding to the at least one frame reference groove.

26. The charging member frame of claim 22, further comprising a charging member cleaner disposed on the charging member frame to clean the charging roller.

27. The charging member frame of claim 22, further comprising a charge eliminating member disposed on the charging member frame to eliminate charge of a photosensitive medium disposed at the main frame of the developing cartridge.

28. A pair of charging roller holders of a developing cartridge, the charge roller holders comprising:

one end to rotatably support a charging roller; and another end to be hinge-connected to a charging member frame;

wherein the charging member frame is detachably disposed at a main frame of the developing cartridge;

wherein when the charging member frame is disposed at the main frame of the developing cartridge, the pair of charging roller holders allows the charging roller to contact a photosensitive medium of the developing cartridge.

29. A charging roller of a developing cartridge, the charging roller comprising:

a pair of charging roller holders to be hinge-connected to a charging member frame to rotatably support the charging roller;

wherein the charging member frame is detachably disposed at a main frame of the developing cartridge;

wherein when the charging member frame is disposed at the main frame of the developing cartridge, the pair of charging roller holders allows the charging roller to contact a photosensitive medium of the developing cartridge.

30. A developing cartridge comprising:

a main frame comprising a photosensitive medium;

a charging member frame comprising a charging member to charge the photosensitive medium and detachably disposed at the main frame; and a pair of charging roller holders configured in that one end of each of the charging roller holders supports a shaft of the charging roller and the other end of each of the charging roller holders is hinge-connected to the charging member frame;

wherein when the charging member frame is disposed at the main frame, the pair of charging roller holders allows the charging roller to contact the photosensitive medium.

31. An image forming apparatus comprising:

a printing medium feeding unit to feed a printing medium;

a developing cartridge to form an image corresponding to printing data on a photosensitive medium, the developing cartridge comprising:

a main frame comprising the photosensitive medium;

a charging member frame comprising a charging member to charge the photosensitive medium and detachably disposed at the main frame; and a pair of charging roller holders configured in that one end of each of the charging roller holders supports a shaft of the charging roller and the other end of each of the charging roller holders is hinge-connected to the charging member frame;

wherein when the charging member frame is disposed at the main frame, the pair of charging roller holders allows the charging roller to contact the photosensitive medium a transferring roller disposed to rotate in contact with the photosensitive medium and to transfer the image on the photosensitive medium onto the printing medium fed from the printing medium feeding unit; and a discharging unit to discharge the printing medium having the image formed.

32. A developing cartridge comprising:

a main frame comprising a photosensitive medium; and a charging member frame comprising a charging member to charge the photosensitive medium and detachably disposed at the main frame, wherein the charging member comprises:

a charging roller; and a pair of charging roller holders configured in that one end of each of the charging roller holders supports a shaft of the charging roller and the other end of each of the charging roller holders is hinge-connected to the charging member frame.

33. The developing cartridge of claim 32, further comprising:

an elastic member disposed between the charging roller holders and the charging member frame.

34. A developing cartridge comprising:

a developing frame comprising a photosensitive medium;

a used toner frame to store used toner to be removed from the photosensitive medium;

a charging member frame comprising a charging member to charge the photosensitive medium and detachably disposed at the used toner frame; and left and right side plates detachably disposed at the left side and the right side of the developing frame and the used toner frame to couple the developing frame and the used toner frame, wherein the charging member comprises:

a charging roller; and a pair of charging roller holders configured in that an end of each of the charging roller holders to support a shaft of the charging roller and the other end of each of the charging roller holder is hinge-connected to the charging member frame.

35. The developing cartridge of claim 34, further comprising:

an elastic member disposed between the charging roller holders and the charging member frame.

36. An image forming apparatus comprising:

a printing medium feeding unit to feed a printing medium;

a developing cartridge to form an image corresponding to printing data on a photosensitive medium, the developing cartridge comprising;

a developing frame comprising the photosensitive medium;

a used toner frame to store used toner to be removed from the photosensitive medium a charging member frame a charging member to charge the photosensitive medium, detachably disposed at the used toner frame, and comprising a charging roller and a pair of charging roller holders configured in that an end of each of the charging roller holders to support a shaft of the charging roller and the other end of each of the charging roller holder is hinge-connected to the charging member frame; and left and right side plates detachably disposed at the left side and the right side of the developing frame and the used toner frame to couple the developing frame and the used toner frame;

a transferring roller disposed to rotate in contact with the photosensitive medium and to transfer the image on the photosensitive medium onto the printing medium fed from the printing medium feeding unit; and a discharging unit to discharge the printing medium having the image formed.

* * * * *